US009827462B2

(12) United States Patent
Siqueira

(10) Patent No.: US 9,827,462 B2
(45) Date of Patent: Nov. 28, 2017

(54) APPARATUS FOR PHYSICAL EXERCISE

(71) Applicant: Rodrigo Dias Siqueira, São José do Rio Pardo (BR)

(72) Inventor: Rodrigo Dias Siqueira, São José do Rio Pardo (BR)

( * ) Notice: Subject to any disclaimer, the term of this patent is extended or adjusted under 35 U.S.C. 154(b) by 0 days.

(21) Appl. No.: 15/063,014

(22) Filed: Mar. 7, 2016

(65) Prior Publication Data

US 2017/0252605 A1 Sep. 7, 2017

(51) Int. Cl.

| | |
|---|---|
| ***A63B 21/04*** | (2006.01) |
| ***A63B 22/20*** | (2006.01) |
| ***A63B 21/00*** | (2006.01) |
| ***A63B 21/16*** | (2006.01) |
| ***A63B 23/02*** | (2006.01) |
| *A63B 21/055* | (2006.01) |

(52) U.S. Cl.

CPC ..... *A63B 22/201* (2013.01); *A63B 21/04* (2013.01); *A63B 21/16* (2013.01); *A63B 21/4034* (2015.10); *A63B 21/4045* (2015.10); *A63B 23/02* (2013.01); *A63B 21/00061* (2013.01); *A63B 21/055* (2013.01); *A63B 21/0552* (2013.01); *A63B 2022/206* (2013.01)

(58) Field of Classification Search

CPC ... A63B 22/201; A63B 21/04; A63B 21/4045; A63B 21/4034; A63B 21/16; A63B 21/00061; A63B 21/0552; A63B 21/055; A63B 23/02; A63B 2022/206

See application file for complete search history.

(56) References Cited

U.S. PATENT DOCUMENTS

| | | | | |
|---|---|---|---|---|
| 2,682,402 A * | 6/1954 | McCarthy | A63B 17/00 482/121 |
| 5,232,423 A * | 8/1993 | Hajduczek | A63B 26/003 482/66 |
| 7,955,240 B2 * | 6/2011 | Nadim | A63B 21/0618 482/146 |
| 9,586,079 B1 * | 3/2017 | Jones | A63B 21/0552 |
| 2014/0206478 A1 * | 7/2014 | Sidley | A63B 69/002 473/446 |
| 2015/0065320 A1 * | 3/2015 | Anderson | A63B 21/0428 482/142 |

* cited by examiner

*Primary Examiner* — Loan H Thanh

*Assistant Examiner* — Megan Anderson

(74) *Attorney, Agent, or Firm* — B. Aaron Schulman, Esq.; Stites & Harbison, PLLC

(57) ABSTRACT

An apparatus for physical exercise, more particularly, a ramp-like equipment which is provided with a frame that supports "U"-shaped concave tracks on which a cart on wheels slides so that it can move up and down, the upper portion of which is provided with a structure composed of stainless steel bars that may be arranged for different supports on which the user is supported and, with the aid of a number of accessories such as belts and handles, he/she can practice different exercises, thus making it possible to apply same to any fitness equipment designed for the fitness and health market.

14 Claims, 33 Drawing Sheets

APPARATUS FOR PHYSICAL EXERCISE

FIELD OF THE INVENTION

The present invention is directed to a fitness equipment.

BACKGROUND OF THE INVENTION

Several techniques for performing exercises are known wherein movements of deflection, extension, rotation, inclination of the column and limbs are performed, however, separately or even jointly in two amplitude of movements, but always on fixed surfaces, that is, without having to change gradually the surface and amplitude of movement concurrently with the exercise.

Another drawback of the techniques in question is that they are not properly suitable for the body of those who want to practice a certain type of sport, mainly medium/high complexity exercises.

The usual techniques do not explore all the movements of the body in an integrated and active form.

Another disadvantage of the existing methods and equipments should be pointed out, in other words the way the exercises for the column are carried out, that is, in a slow anaerobic way that does not allow the aerobic system to be used.

From a critical point of view, it is noticed that to date it is not possible for the user to perform several exercises at one time, thus optimizing the time, the preparation for the daily needs and the practice of sports in general.

SUMMARY OF THE INVENTION

Thus, the object of the invention is to complement and suppress the deficiencies described above, aiming at the complete work of the body, mainly the column and the cardiovascular system. Also, it makes it possible to change the direction, plans and speed of movement all at once, thus making it possible to use the action of the body in connection with the brain in order to keep the balance, coordination and agility which are essential for the optimum performance of the exercise.

The apparatus is a ramp-like equipment, provided with a frame that supports "U"-shaped" concave bars on which a cart slides on wheels to move up and down, the upper portion of which is provided with a structure composed of stainless steel bars that may be arranged for different supports on which the user is supported and, with the aid of a number of accessories such as belts and handles, he/she can practice different exercises, thus making it possible to apply same to any fitness equipment field designed for the fitness and health market.

By means of the cart, the equipment makes it possible so adjust the height by making side rotations during the exercises. In view of the high degree of freedom of direction of the movements, it is possible to integrate the column and limbs in all amplitudes thereof, thus making it possible to perform complex movements aimed at the joints in a safe way, encouraging the user to perform movements that are carried out only in sports requiring a high degree of complexity, for example, the integrated movements of rotation, inclination, deflection, extension and circumduction of the column, hip and limbs at the same time.

Moreover, it makes it possible to change the position in the bars without interrupting the movement, thus providing the user with more agility and motor coordination.

The present invention seeks to provide apparatus for physical exercise, comprising: (a) a frame; (b) a track supported by the frame for rollably supporting a cart and restricting the cart from leaving the track. The track is substantially semi-circular in shape and the cart is mounted for rolling movement along the track and also for supporting a user; (c) a pair of end covers are affixed to the ends of the track to prevent the cart from moving beyond the ends of it; (d) an upper structure extending from the frame upwards above the track having a pair of horizontal bars extending across above the track, and is releaseably attached to the upper structure such that the horizontal bars can be selectively raised away from or lowered toward the track; and (e) adjustable restraining means attached to the upper structure and operatively connected to the cart to provide an adjustable amount of restraining against movement of the cart along the track.

DETAILED DESCRIPTION OF THE INVENTION

Figure 1:
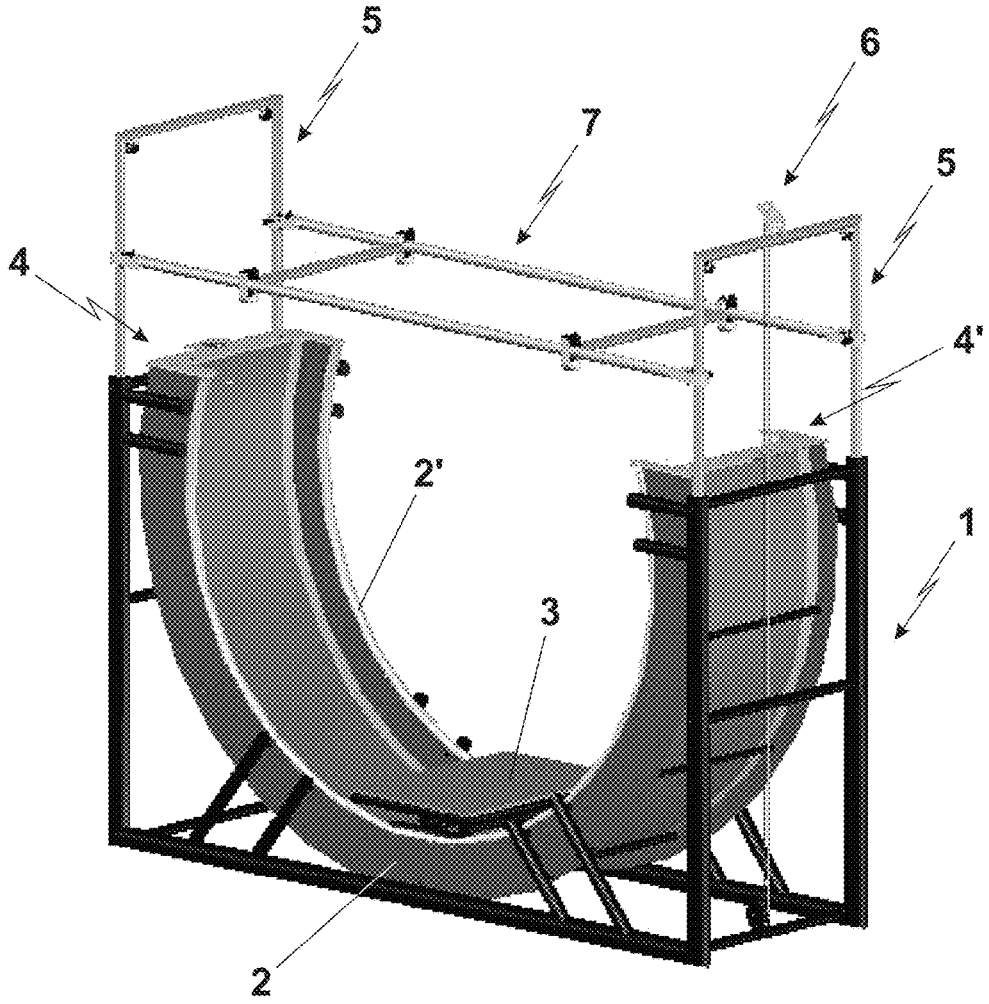
FIG. 1 is a perspective view of the fitness equipment.
Figure 2:
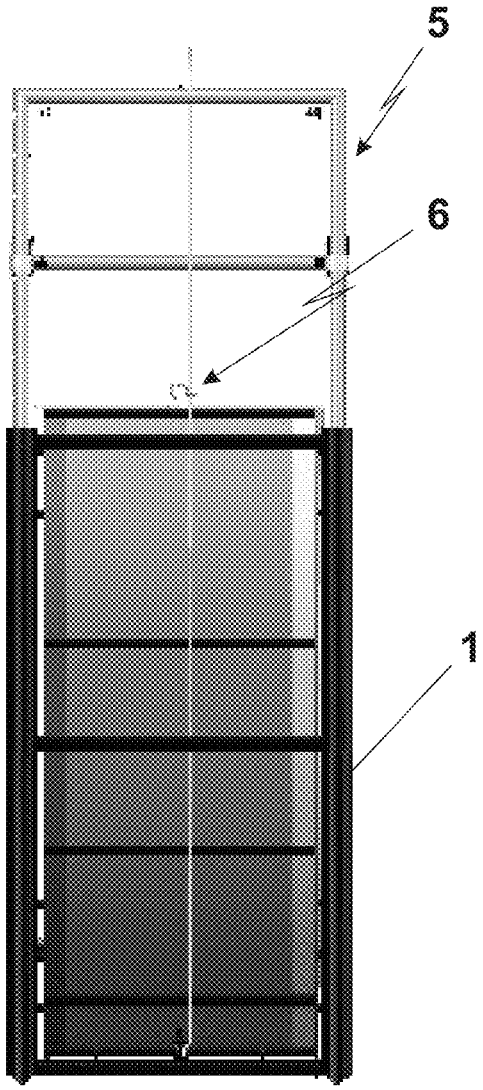
FIG. 2 is a side view of the fitness equipment.
Figure 3:
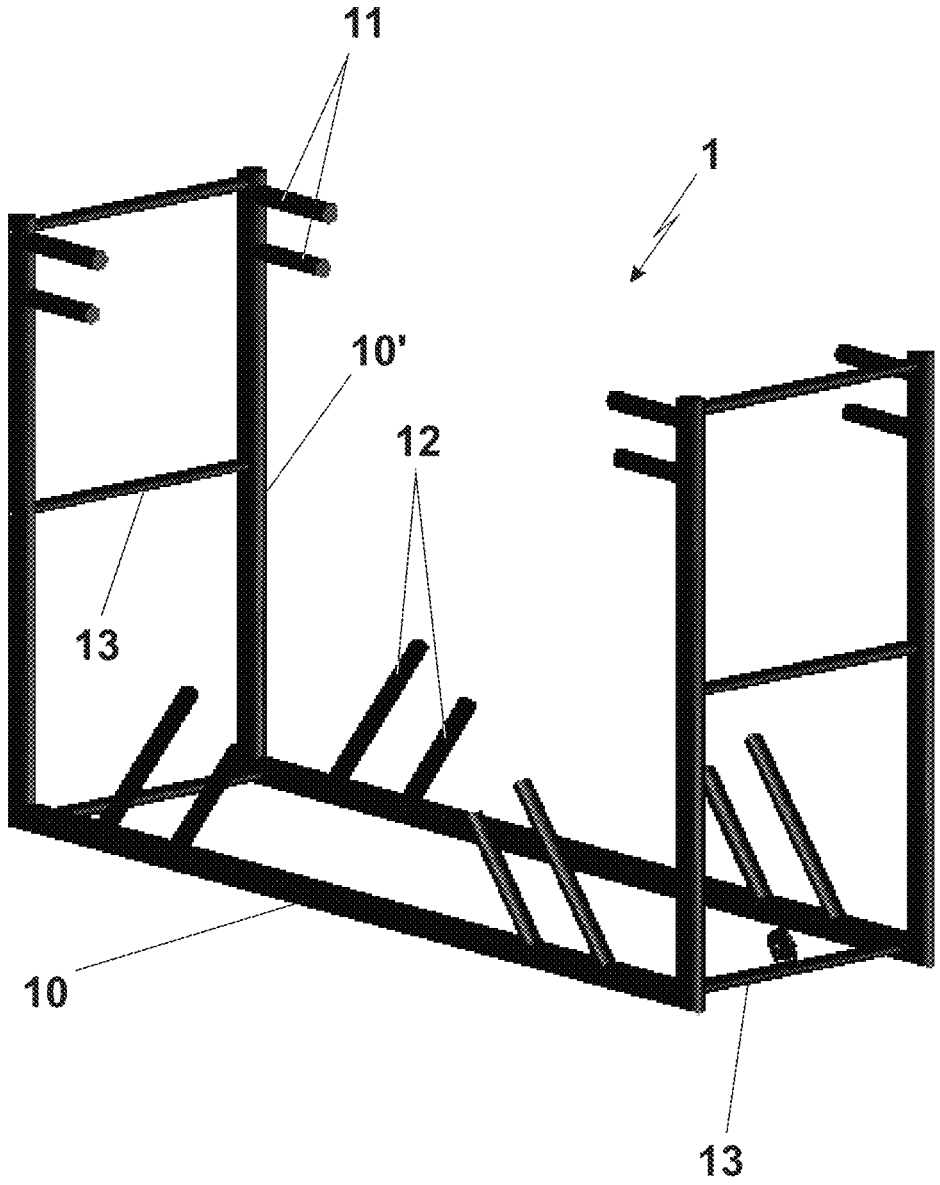
FIG. 3 is a perspective view of the frame of the equipment.
Figure 4:
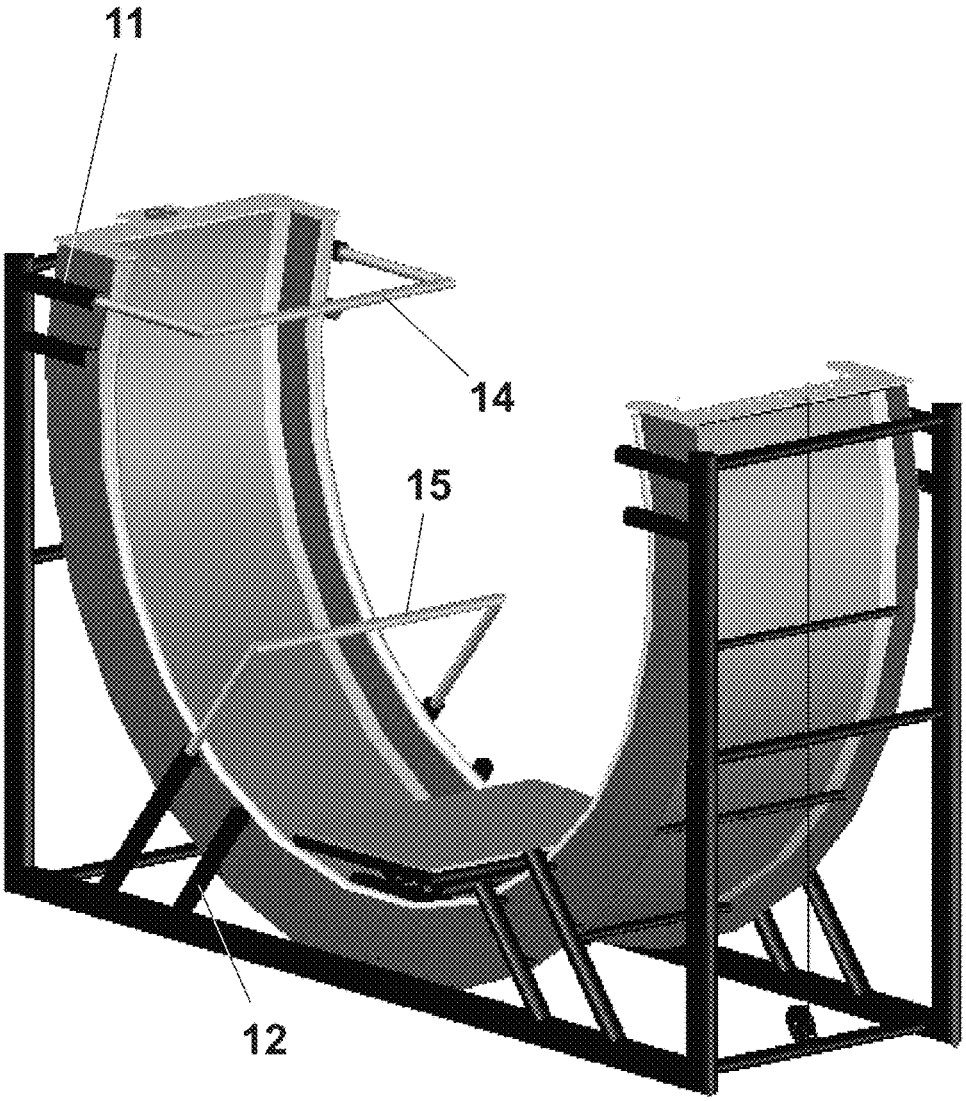
FIG. 4 is a partial perspective view of the equipment, highlighting the lower and intermediate supports.
Figure 5:
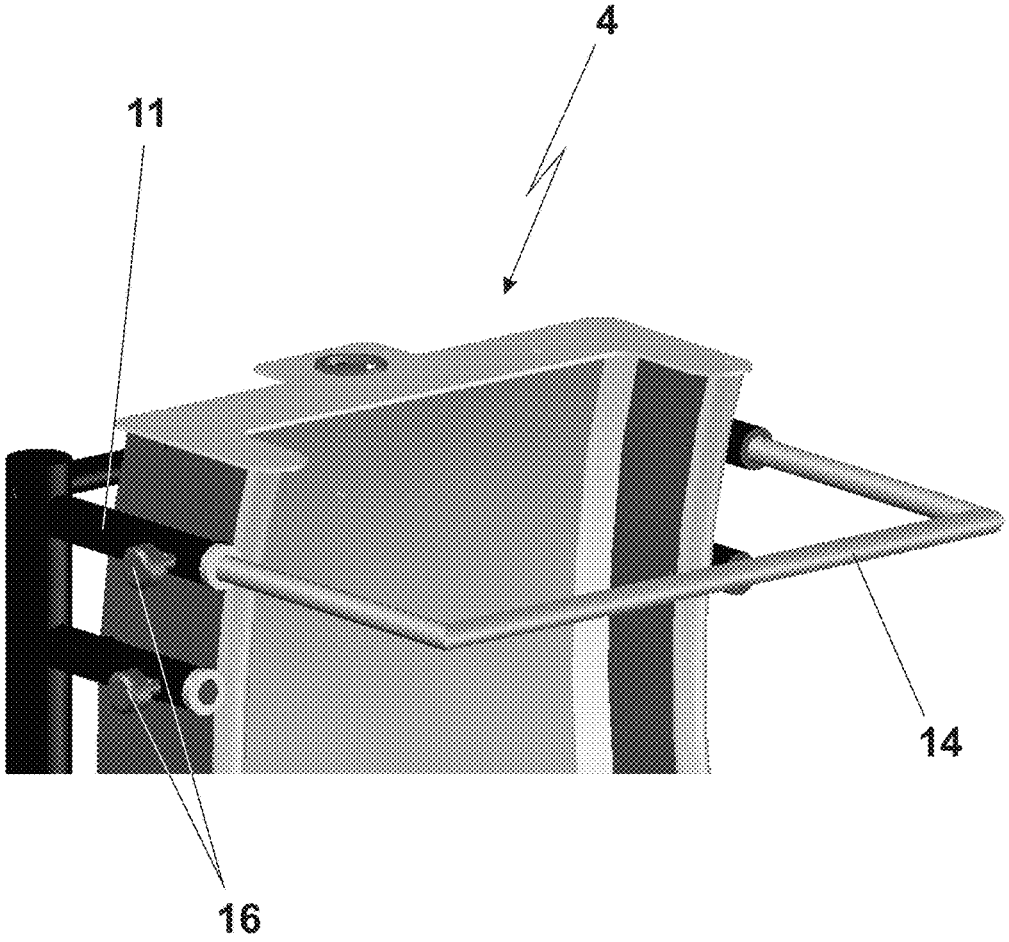
FIG. 5 is a partial perspective view highlighting the intermediate and upper supports.
Figure 6:
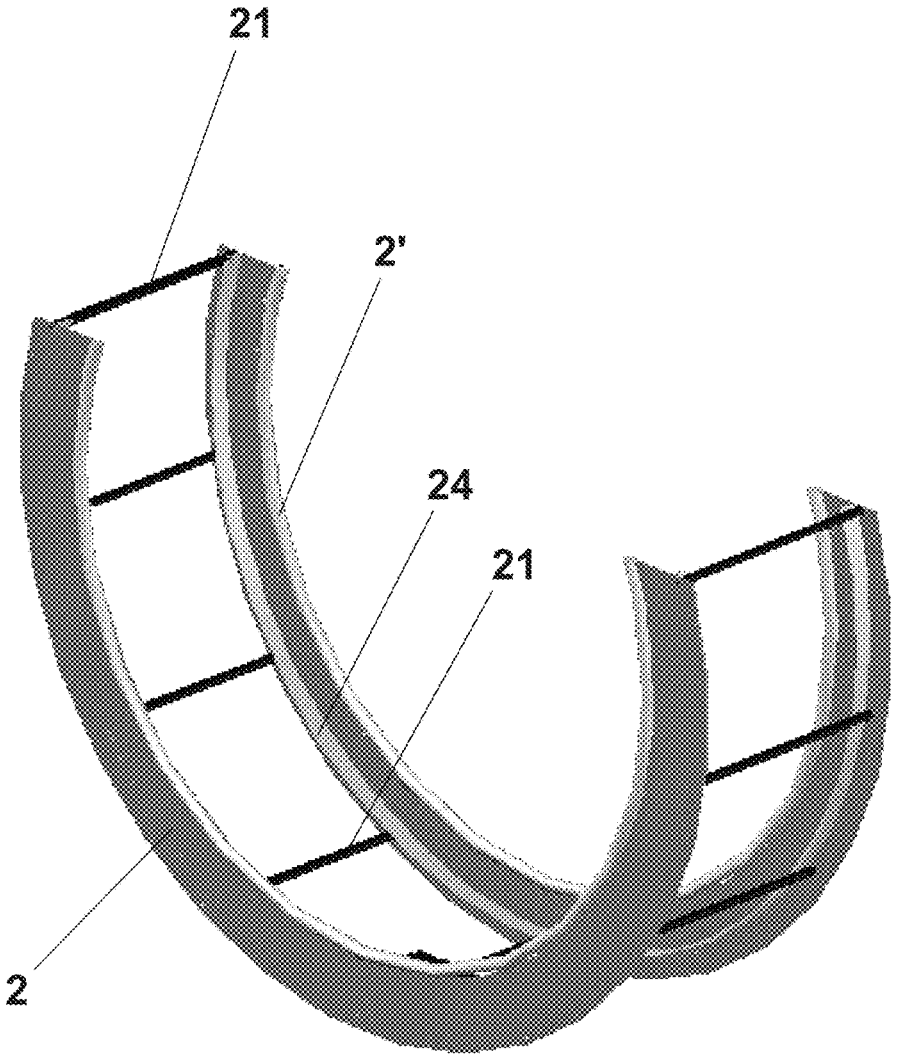
FIG. 6 is a perspective view of the tracks of the equipment.
Figure 7:
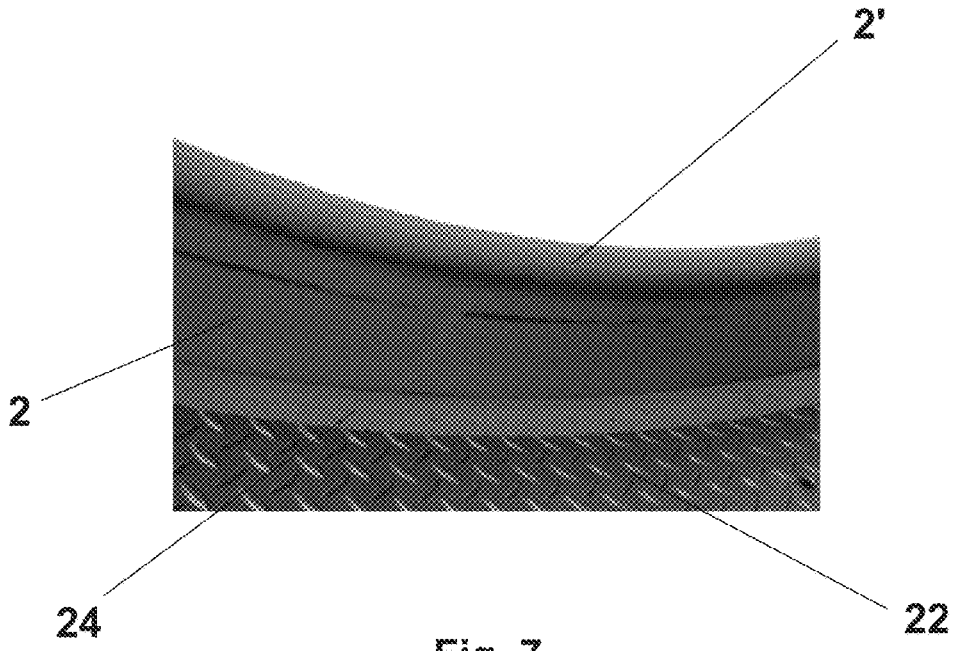
FIG. 7 is a perspective detailed view of the tracks showing the floor.
Figure 8:
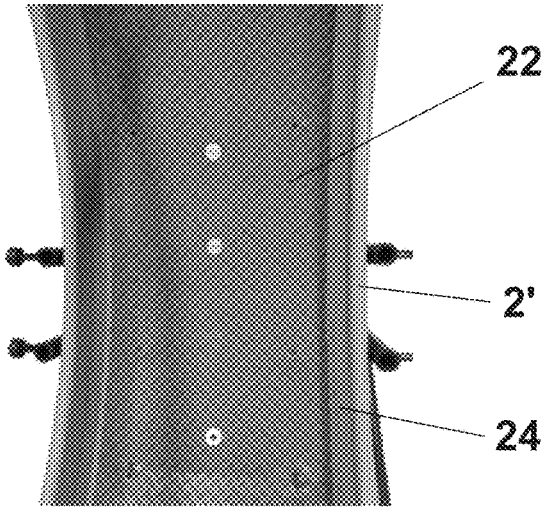
FIG. 8 is a top detailed view of the tracks showing the floor.
Figure 9:
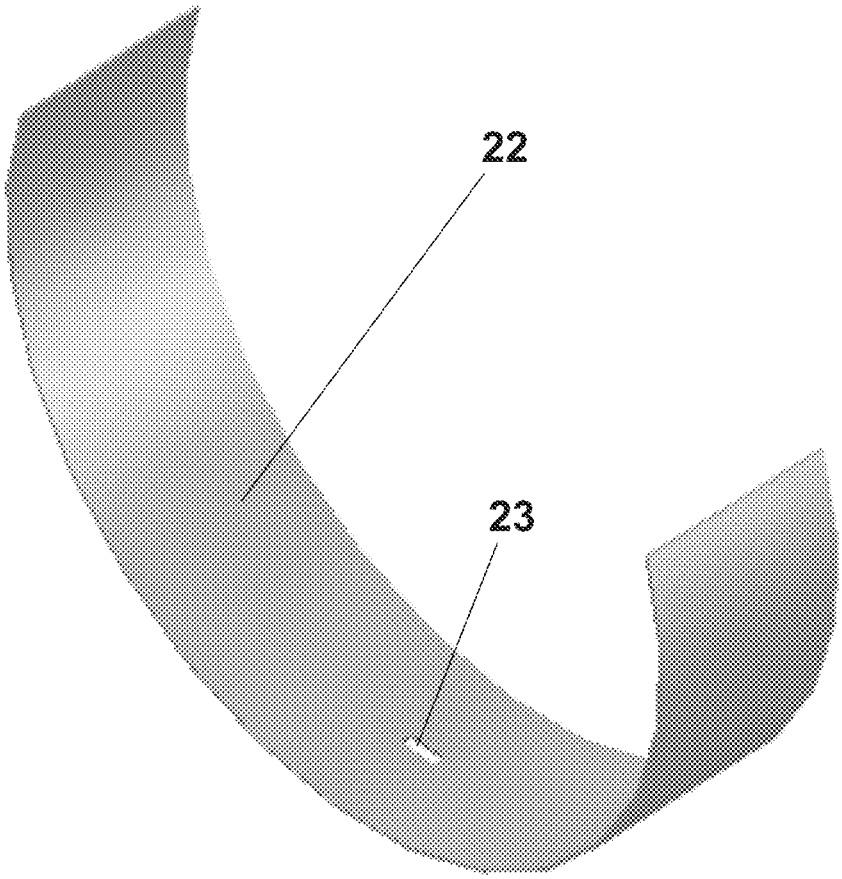
FIG. 9 is a perspective view of the floor of the equipment.
Figure 10:
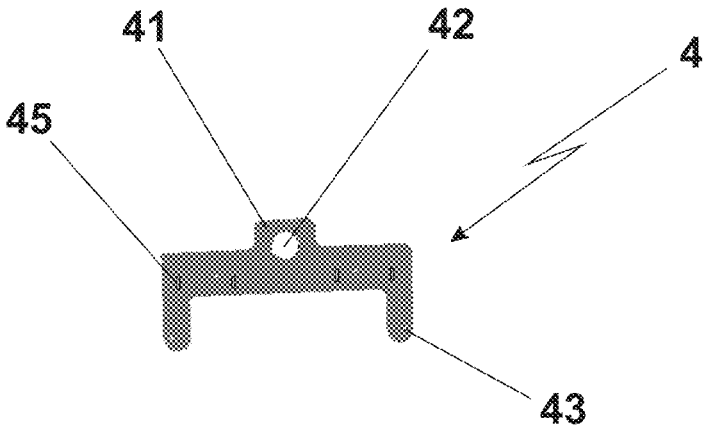
FIG. 10 is a tip view of the end covers of the equipment.
Figure 10:
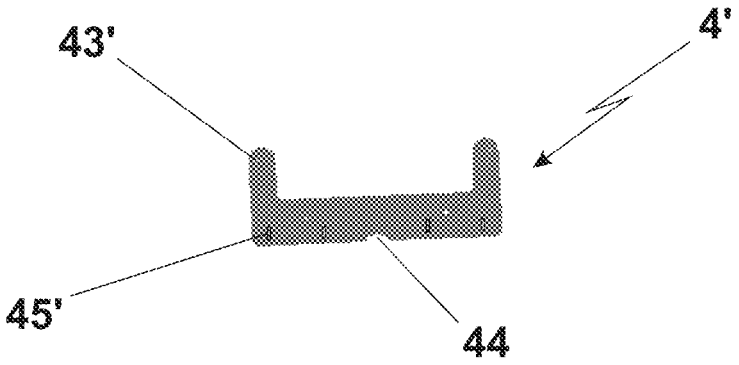
Figure 11:
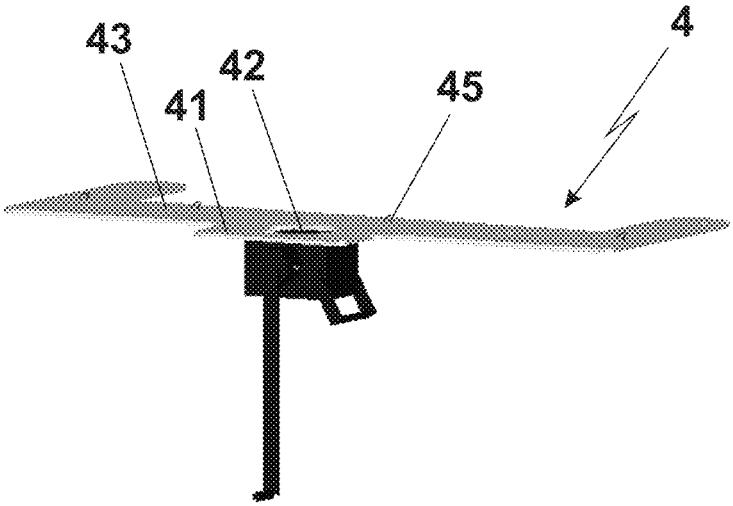
FIG. 11 is a perspective view of one of the end covers of the equipment.
Figure 12:
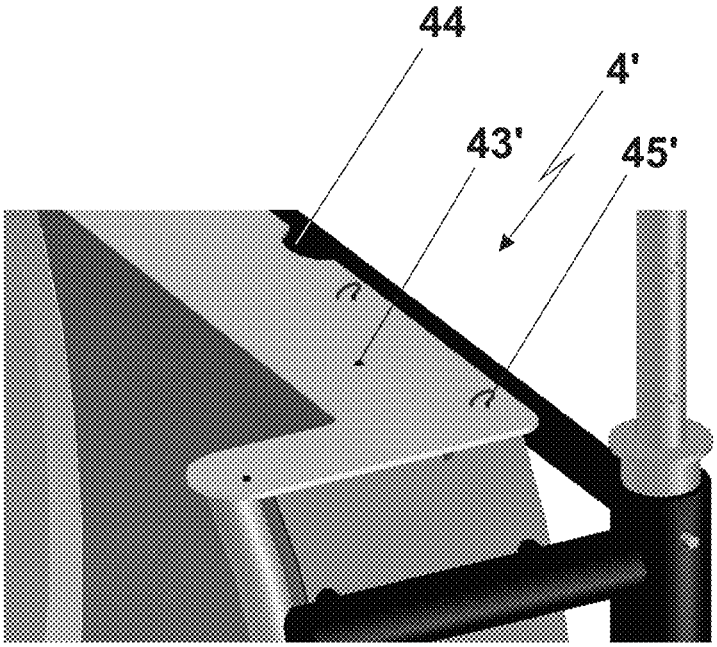
FIG. 12 is a partial perspective view of one of the end covers of the equipment.
Figure 13:
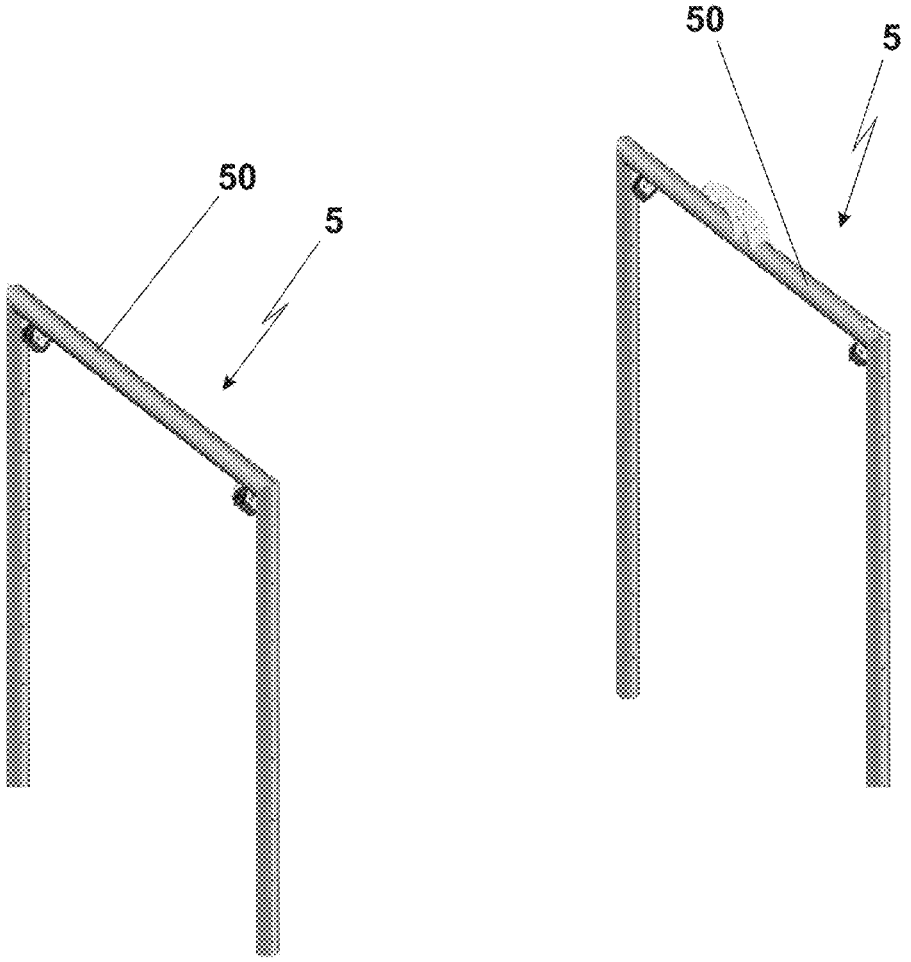
FIG. 13 is a perspective view of the upper bars of the equipment.
Figure 14:
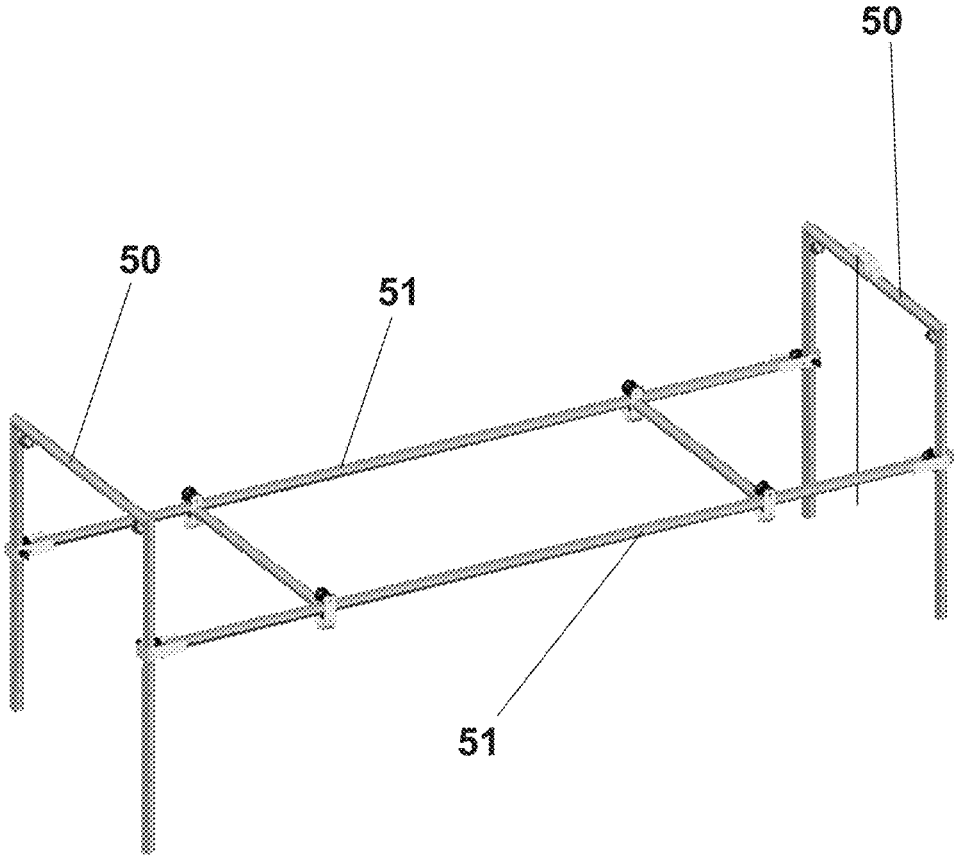
FIG. 14 is a perspective view of the upper bars of the equipment that are joined by horizontal connecting rods.
Figure 15:
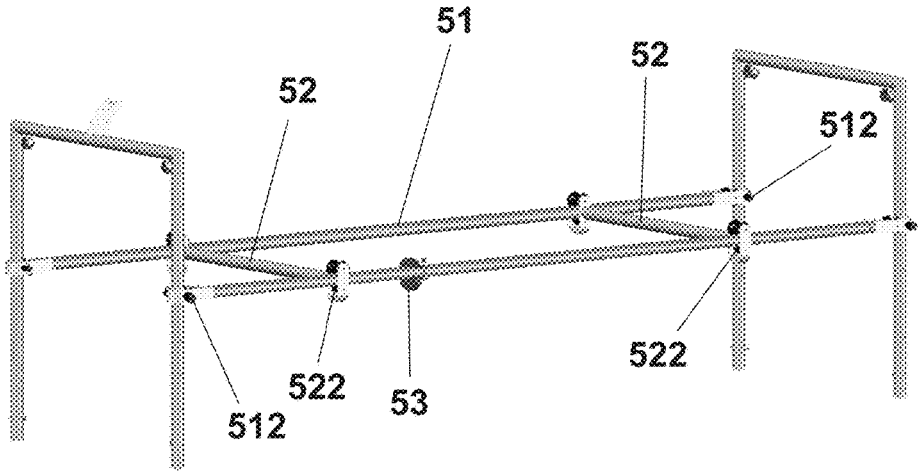
FIG. 15 is a perspective view of the upper structure of the equipment.
Figure 16:
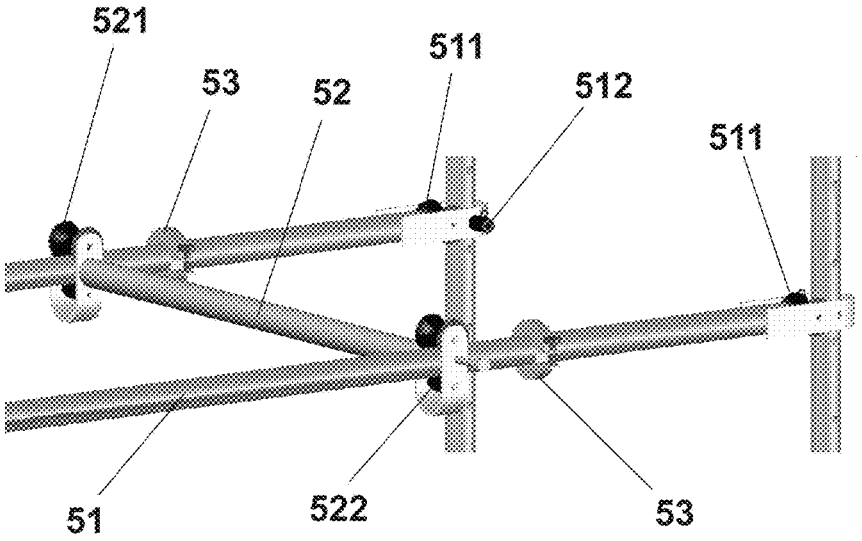
FIG. 16 is a perspective detailed view of the moving crosspieces.
Figure 17:
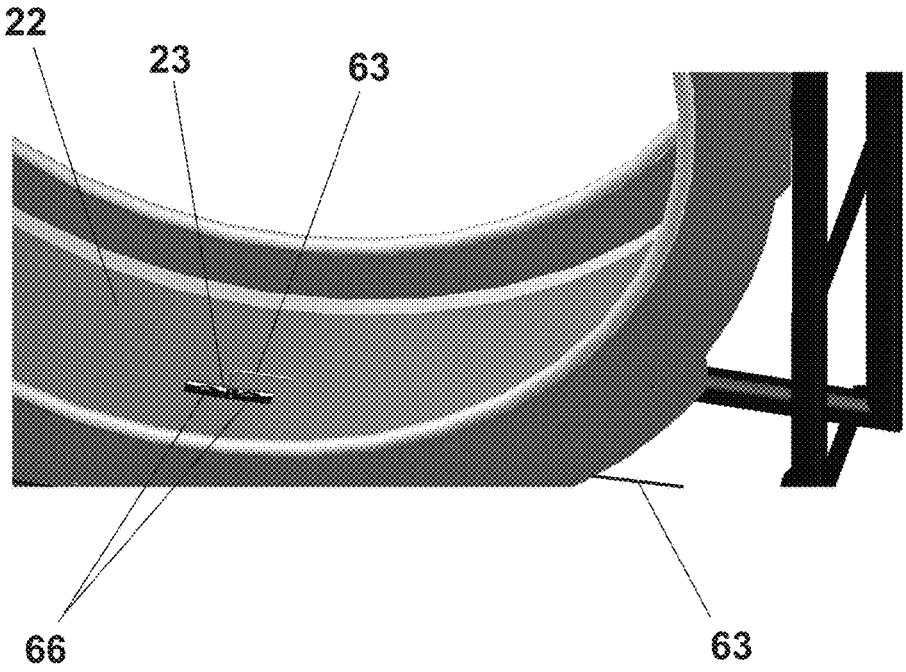
FIG. 17 is a perspective detailed view of the floor showing the central pulleys of the load system of the cart.
Figure 18:
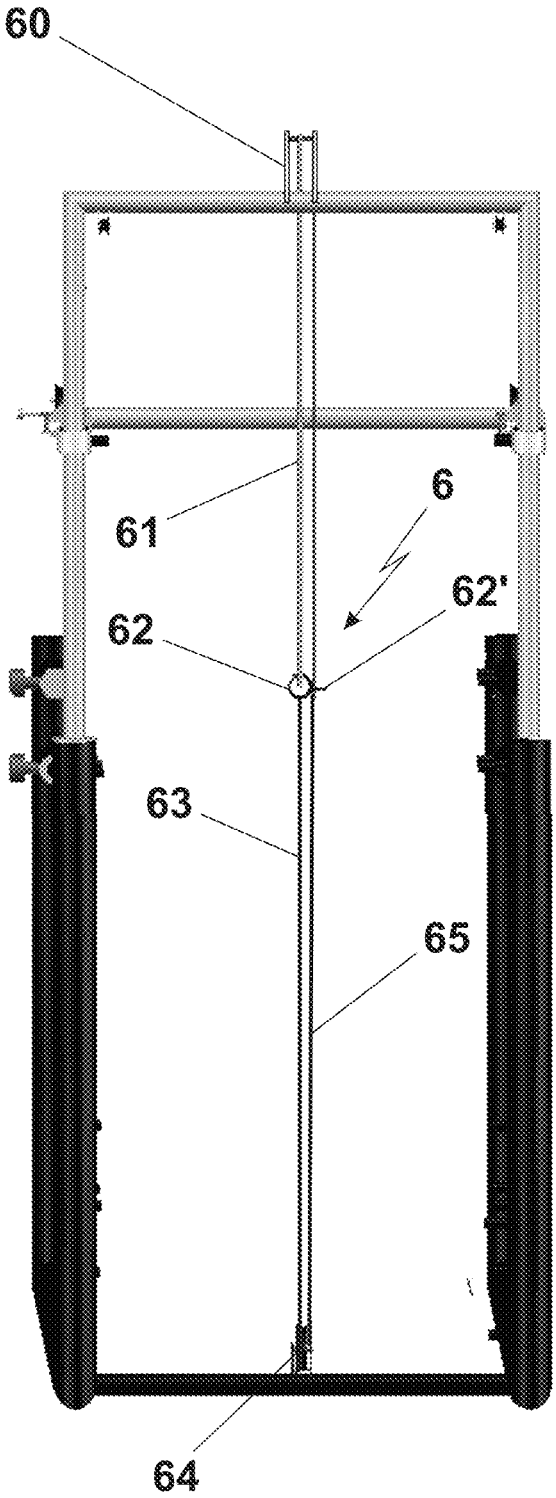
FIG. 18 is a side view of the equipment highlighting the load system.
Figure 19:
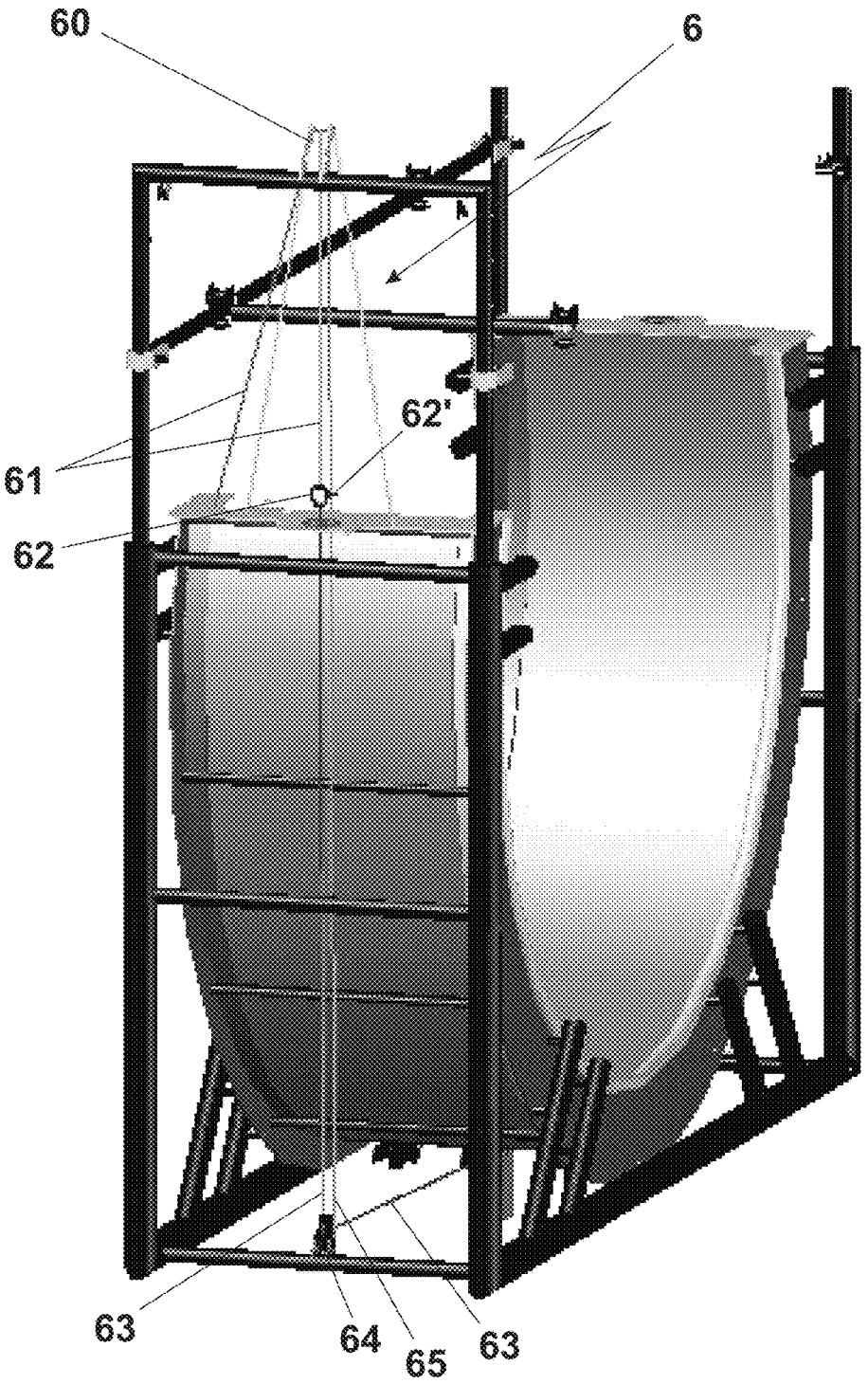
FIG. 19 is a perspective view of the equipment highlighting the load system.
Figure 20:
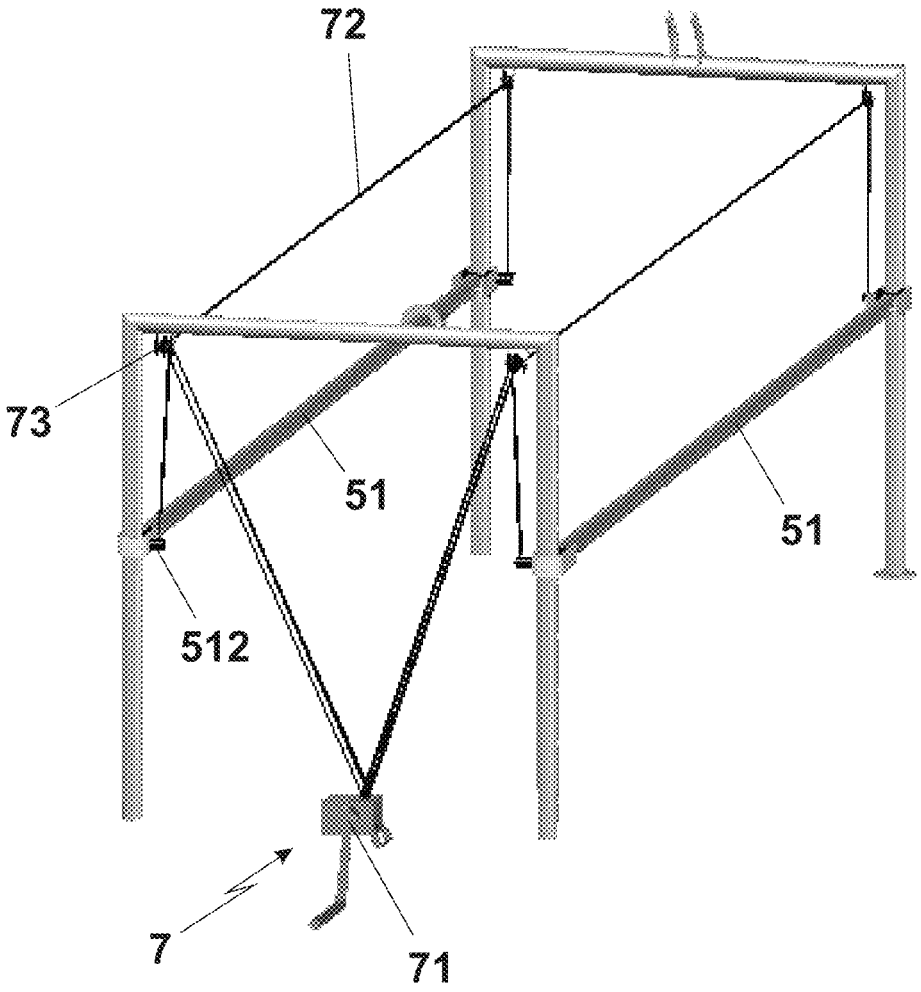
FIG. 20 is a perspective view of the upper structure showing the height adjustment system of the horizontal bars.
Figure 21:
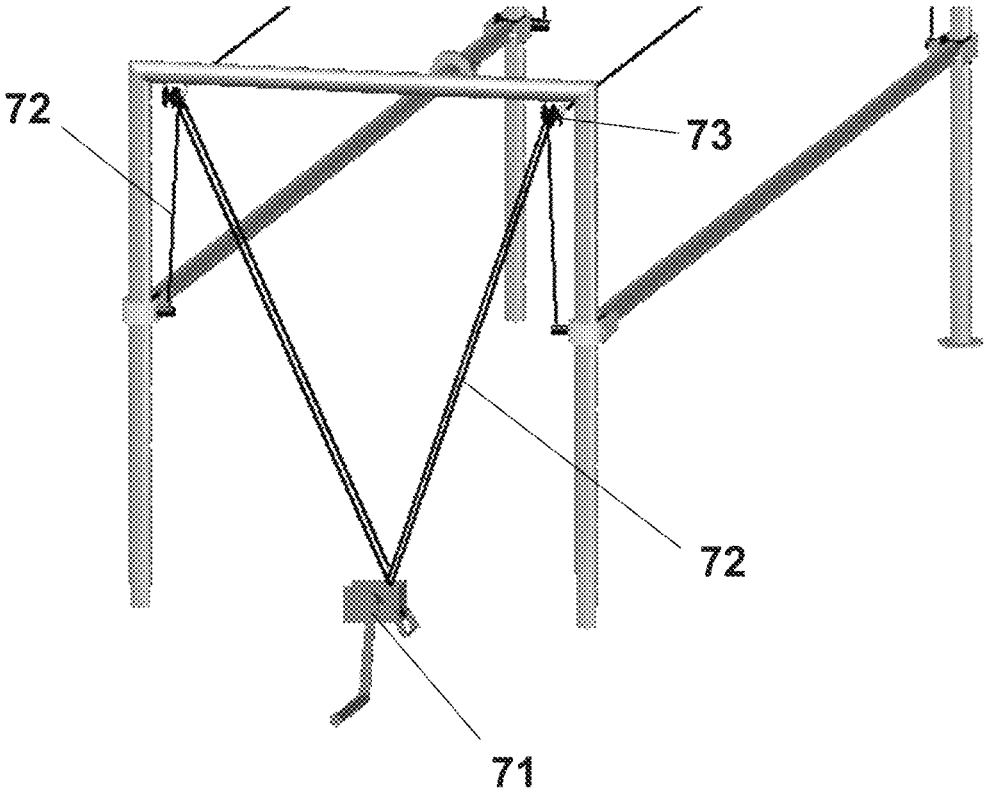
FIG. 21 is a perspective detailed view of the height adjustment system of the horizontal bars.
Figure 22:
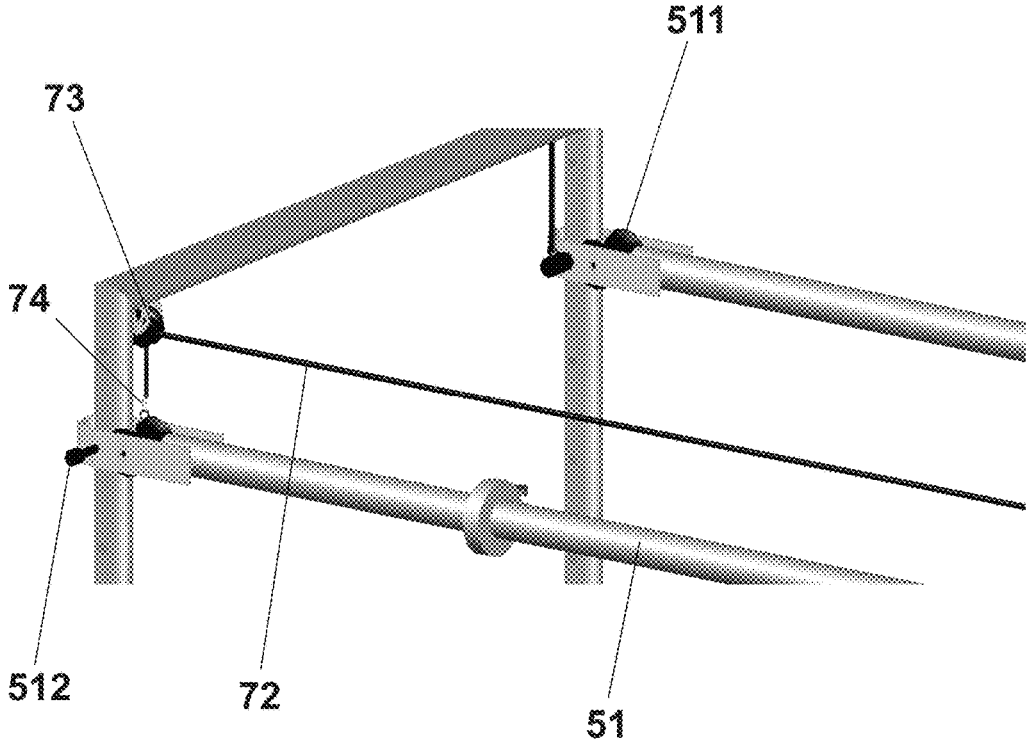
FIG. 22 is a perspective detailed view of the locking system of the horizontal bars.

The object of the invention is a fitness equipment that comprises a frame that supports "U"-shaped" tracks on which a cart slides, thus making it possible to attain a fully efficient slide and stability, as well as upper bars that aid to perform the exercises and to which the load support and accessories such as knobs, safety belts and supports for placing the bars on the side thereof are affixed.

Among the structures, the cart is provided with a support that is split into two portions, a bearing being provided inside same so that it is possible to rotate the upper portion, turning same into the support for performing the exercises, thus making it possible to control the tension and adjustment of the rotation thereof through the load system, in order to increase the weight thereof, fulfilling the needs of every user, by increasing the intensity and difficulty of the exercises.

According to the accompanying figures, the fitness equipment comprises a frame (1) to which lower tracks (2) are affixed, on which the upper cart (3) slides, and upper tracks (2') for restraining the movement of the cart (3), so that end covers (4 and 4') may be affixed to each of the ends of the tracks (2, 2'). The upper structures (5) are fit into the upper corners of the frame (1) to which the load system (6) of the cart (3) and the height adjustment system (7) of the horizontal bars of the upper structures (5) are affixed.

Said frame (1) acts as a support for the rest of the parts of the equipment and is composed of two "U"-shaped side tubular structures (10; 10') having straight corners and provided with horizontal bars (11) and oblique bars (12) directed towards the central axis that form the supports of tracks (2; 2'), such structures (10 and 10') being joined by crosspieces (13) that are screwed, thus forming the supporting frame of the equipment. The bars (11 and 12) are provided with inner reduction bushings for receiving the intermediate supports (14) and the lower supports (15) that are locked by knobs (16).

Said lower tracks (2), made from a laser cut plate are conformed, thus forming a "U"-shaped body to which a plate is welded (24) transversally, thus forming the "T"-shaped lower track (2), and upper tracks (2') made from steel pipes that are calendered to form a "U" are welded to the upper perimeters thereof. The lower tracks (2) are affixed through screws to the crosspieces (11 and 12) as well as affixed to one another through cross bars (21), and the floor (22) that is made of wood, fiber or polycarbonate and affixed to the cross bars (21) through screws is placed on the plate (24).

The "C"-shaped end covers (4; 4') are affixed to the ends of the tracks (2, 2'), so that the end cover (4) is provided with a protuberance (41) wherein a hole (42) is provided for passing the height adjustment cables (7) and also provided with orifices (43) for attaching same to one of the ends of tracks (2; 2'), as well as hooks (45) for the use of elastic cords. The end cover (4'), on its turn, is provided with a semicircular channel (44) for passing the cables of the load system (6), hooks (45') for holding the cables that are not being used, and orifices (43') for attaching same to the other end of the tracks (2; 2').

Said upper structure (5) is composed of two inverted "U"-shaped bodies (50) that are joined by two horizontal parallel connecting rods (51) provided with concave casters (511) on the ends thereof that allow for the vertical displacement to regulate the height according to the stature of the user, through the adjustment system (7) that, when set at the desired height, are locked by knobs (512); said connecting rods (51) receive moving crosspieces (52), the ends of which are also provided with concave casters (521) that allow same to move horizontally and the movement of which is restrained by movement restrainers (53) that may be placed in accordance with the convenience of the exercise or may be locked by knobs (522).

Said load system (6) is composed of a support (60) for holding vertical rubber bands (61) of different intensities to load the cart (3) which, when not in use, are held by the hooks (45) of the end cover (4') and, when in use, are held by a ring (62) that is affixed to a non-elastic cable (63) that passes around a pulley (64) and is affixed to the cart (3). On the other hand, a non-elastic cable (65) that passes through the ring (62') orthogonal to the ring (62) that restrains the movement of the latter is provided. Said pulley (64) is affixed to one of the crosspieces (13) of the frame (1) and the cable (63) is placed as far as the middle of a pair of pulleys (66) affixed to the center of the frame (1) and passes around same, thus crossing the floor (22) through the slot (23), the end of which is affixed to the lower medium portion of the cart (3), thus making it possible to the move same to both sides.

The height adjustment system (7) of the horizontal bars (51) of the upper structure (5) is composed of a ratchet (71) that drives the connecting rods (51) by means of steel cables (72) that pass around the pulleys (73) affixed to the cups (50), said steel cables (72) being affixed to said connecting rods (51) by a spring hook (74).

Figure 23:
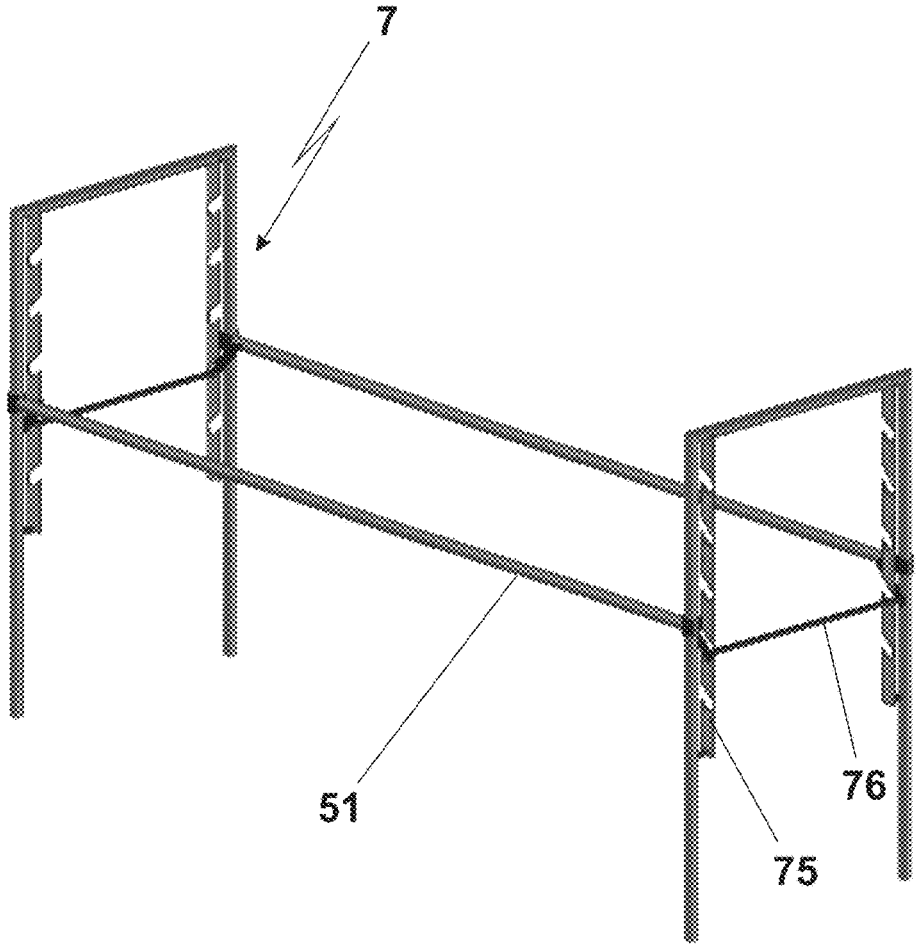
FIG. 23 is a perspective view of a constructive variant of the height adjustment system of the horizontal bars.

In accordance with FIG. 23, optionally, the adjustment system (7) is operated manually through a butterfly lock that is provided with toothed plates (75) into which the swivel rods (76) that are affixed to the ends of the connecting rods (51) are fit.

Figure 24:
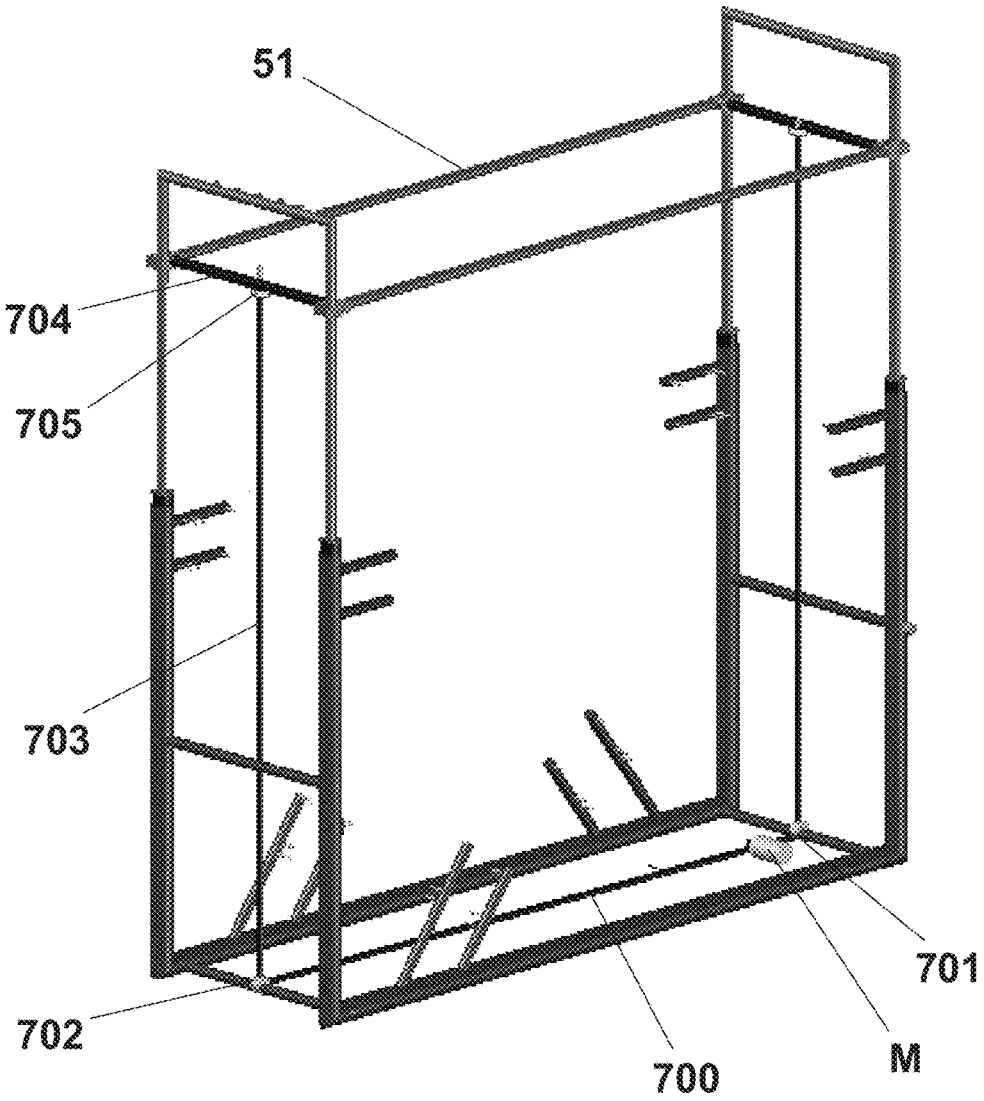
FIG. 24 is a perspective view of a second constructive variant of the height adjustment system of the horizontal bars.
Figure 25:
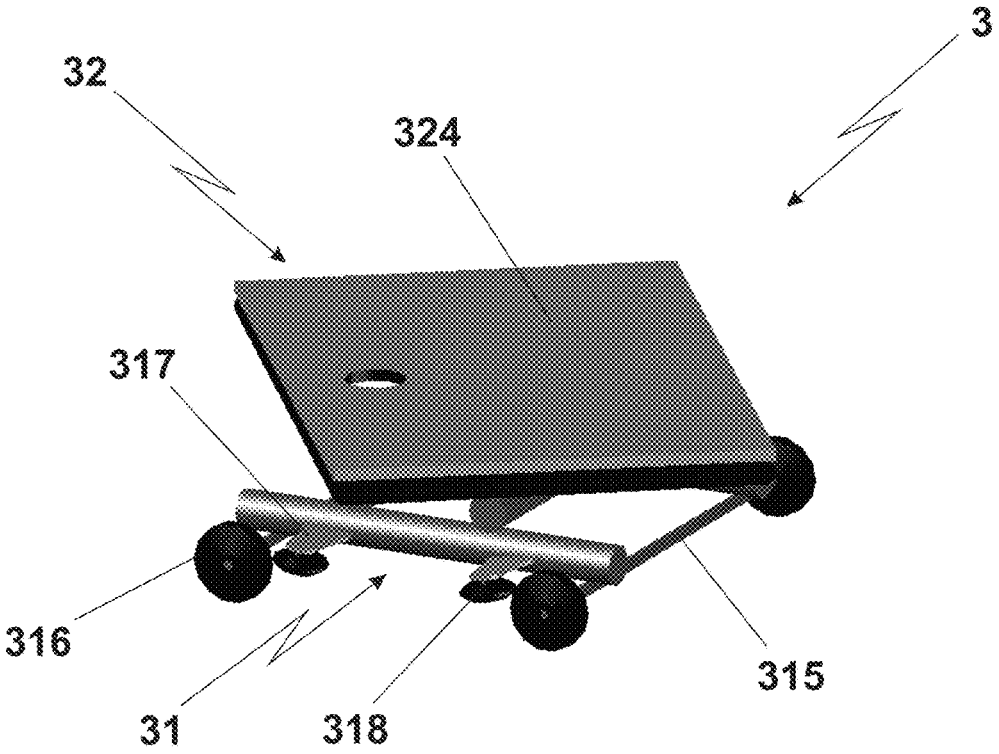
FIG. 25 is a perspective view of the cart.
Figure 26:
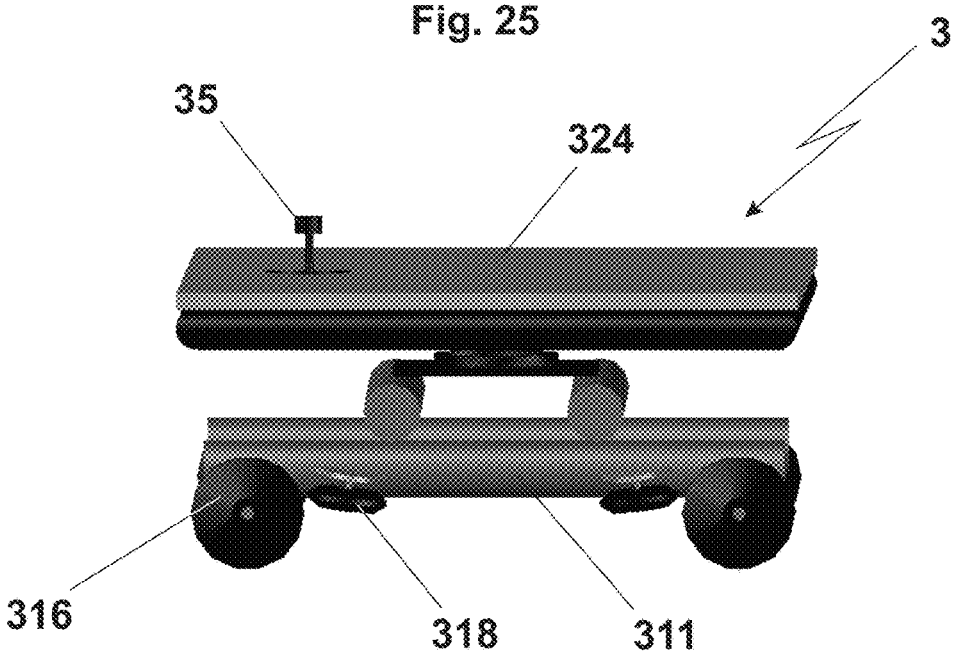
FIG. 26 is a front view of the cart.
Figure 27:
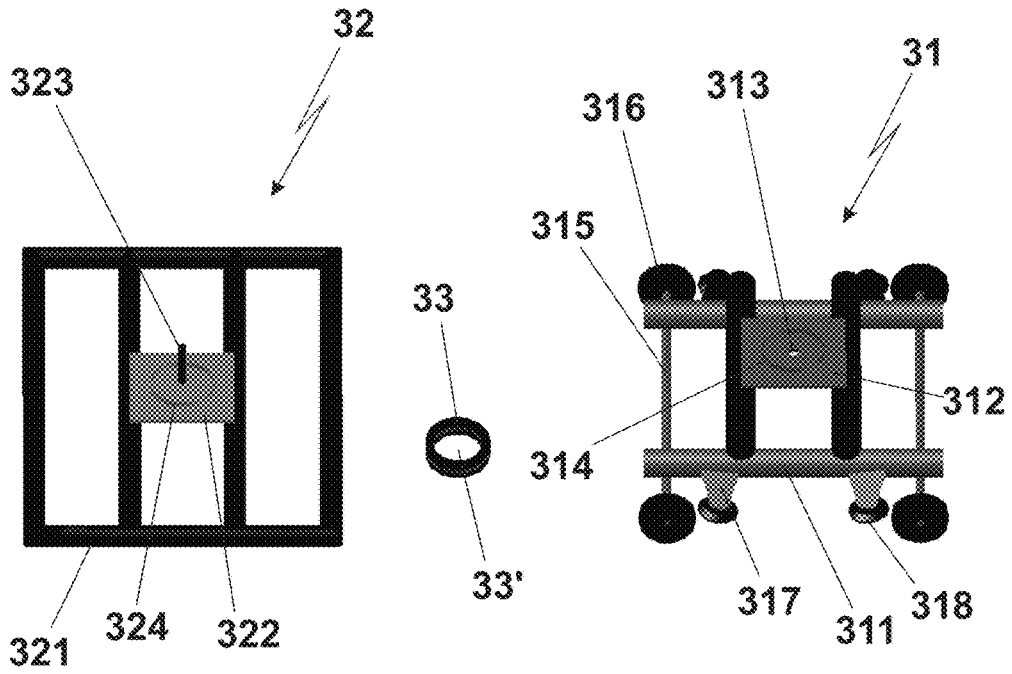
FIG. 27 is a perspective view of the structure of the disassembled cart.
Figure 28:
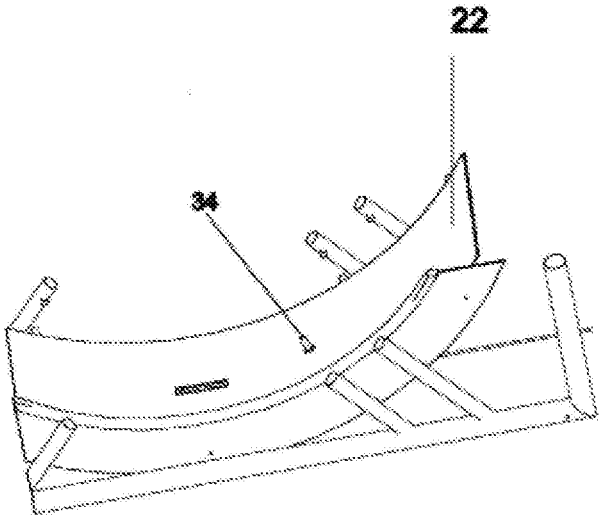
FIG. 28 is a perspective detailed view of the movement restrainer of the cart applied to the floor.
Figure 29:
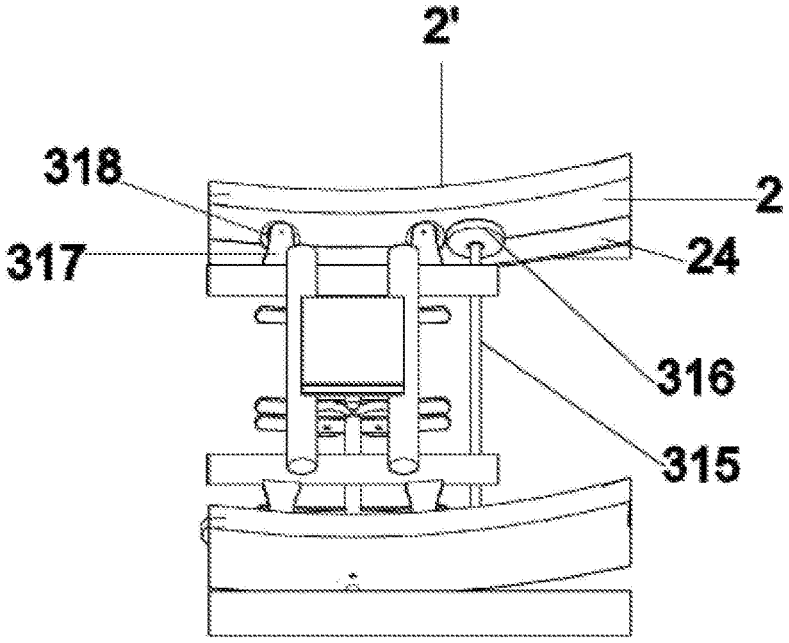
FIG. 29 is a perspective detailed view of the casters of the cart contacting the tracks.
Figure 30:
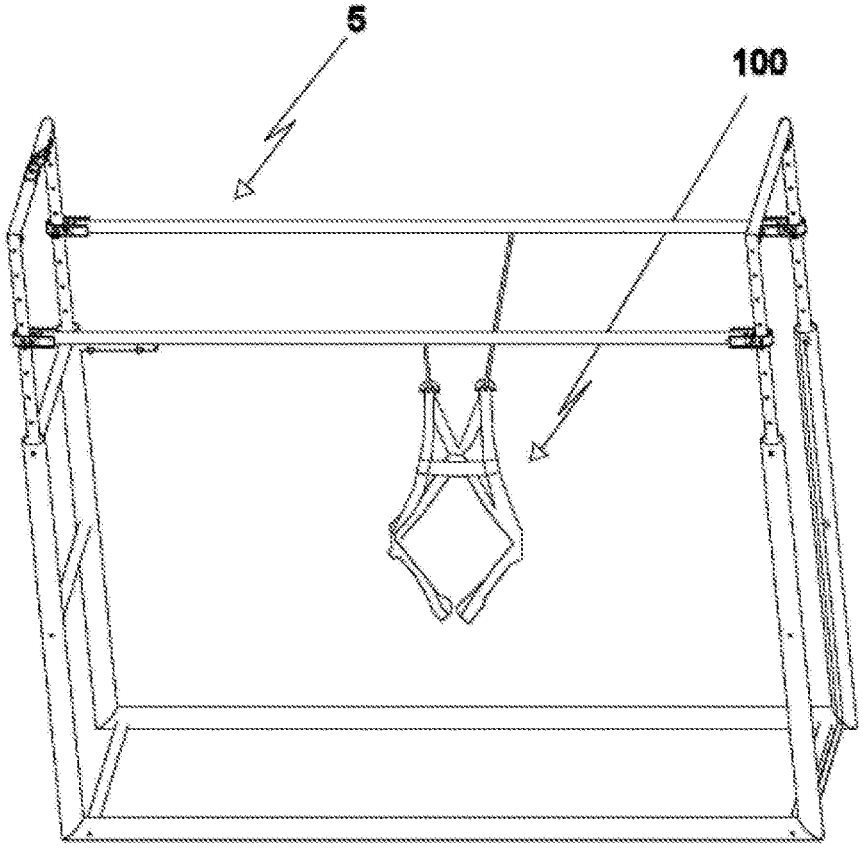
FIG. 30 is a perspective detailed view of the accessories.
Figure 31:
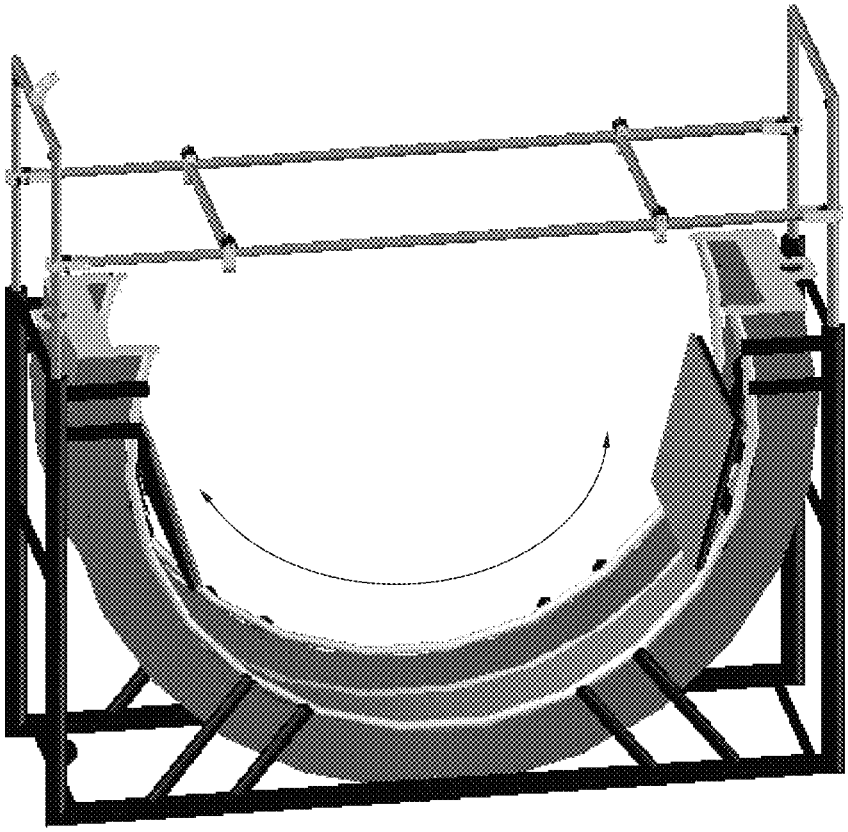
FIG. 31 is a perspective view of the equipment, showing the movements of the cart.
Figure 32:
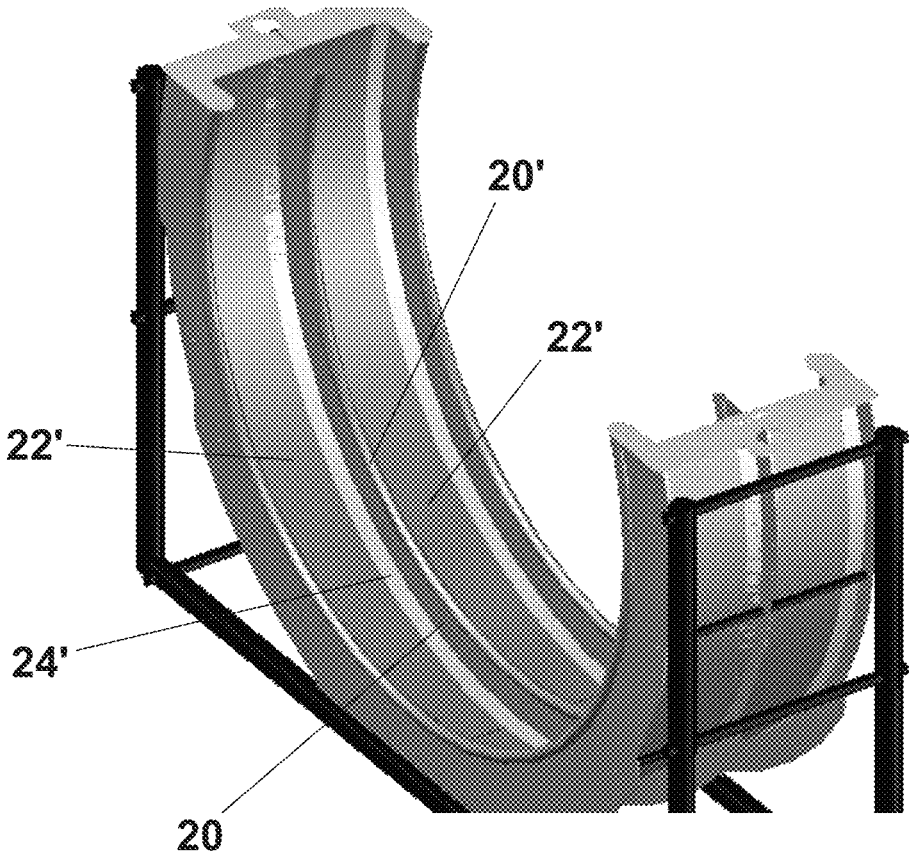
FIG. 32 is a partial perspective view of a constructive variant of the equipment tracks.
Figure 33:
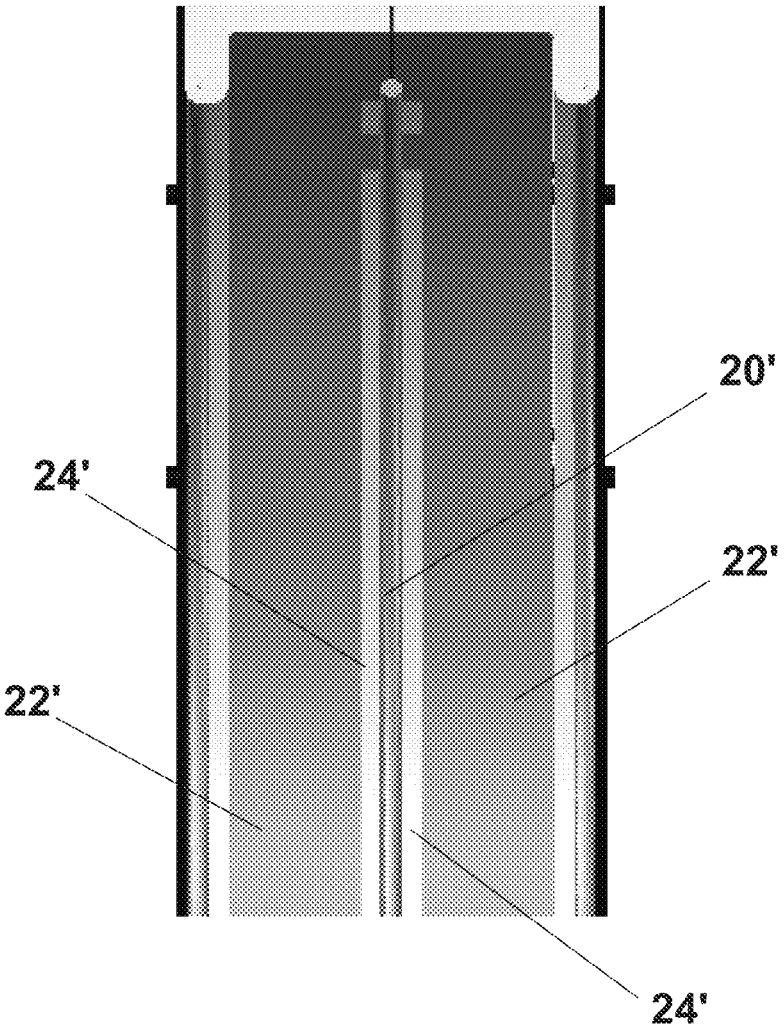
FIG. 33 is a detailed view of a constructive variant of the equipment tracks.
Figure 34:
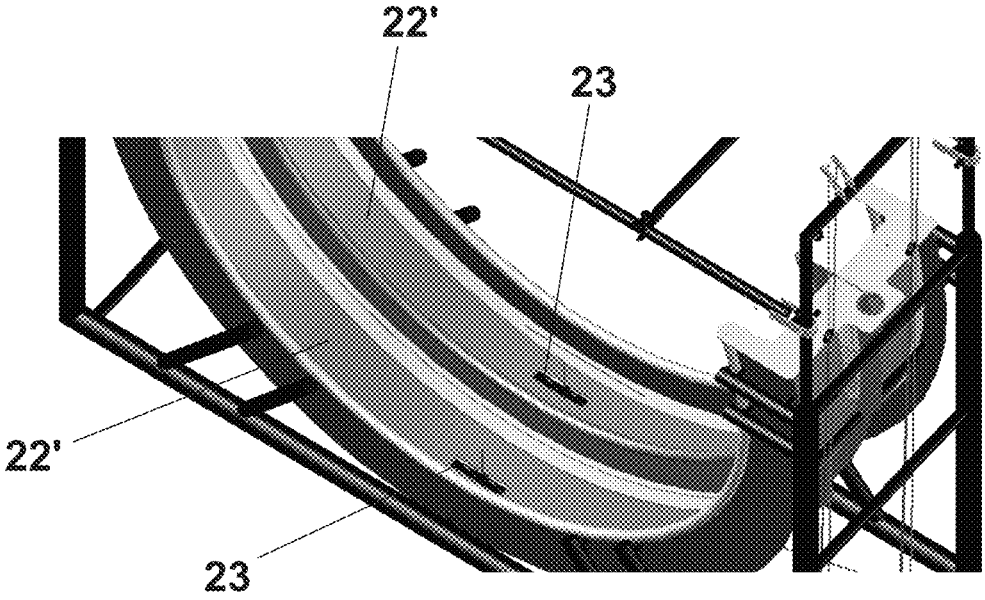
FIG. 34 is a partial perspective view of a constructive variant of the equipment tracks, highlighting the load system.
Figure 35:
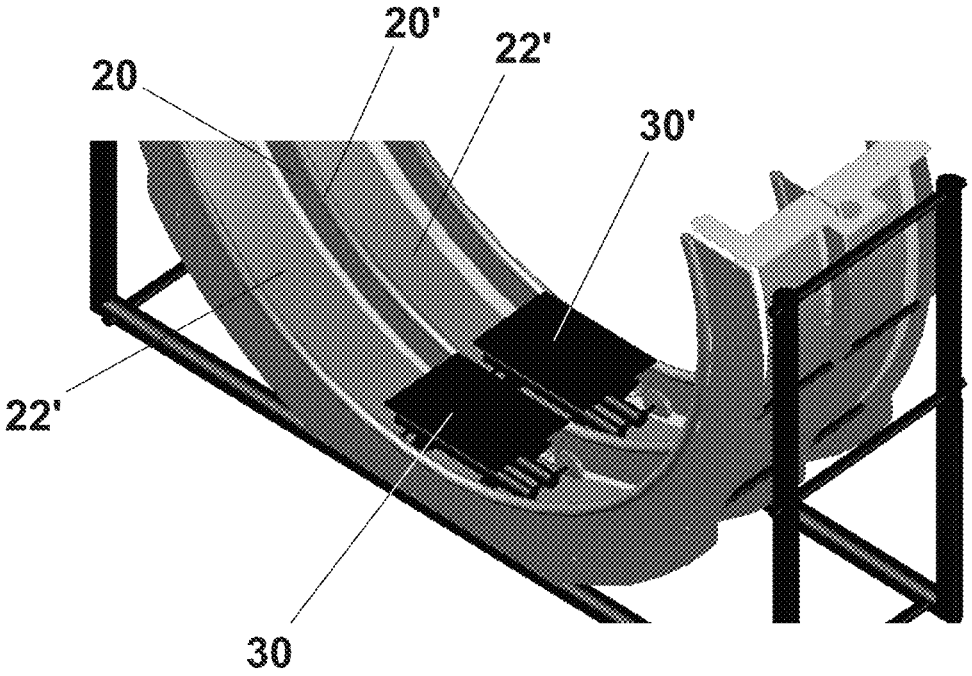
FIG. 35 is a partial perspective view of a constructive variant of the track of the equipment, highlighting the carts on the tracks.
Figure 36:
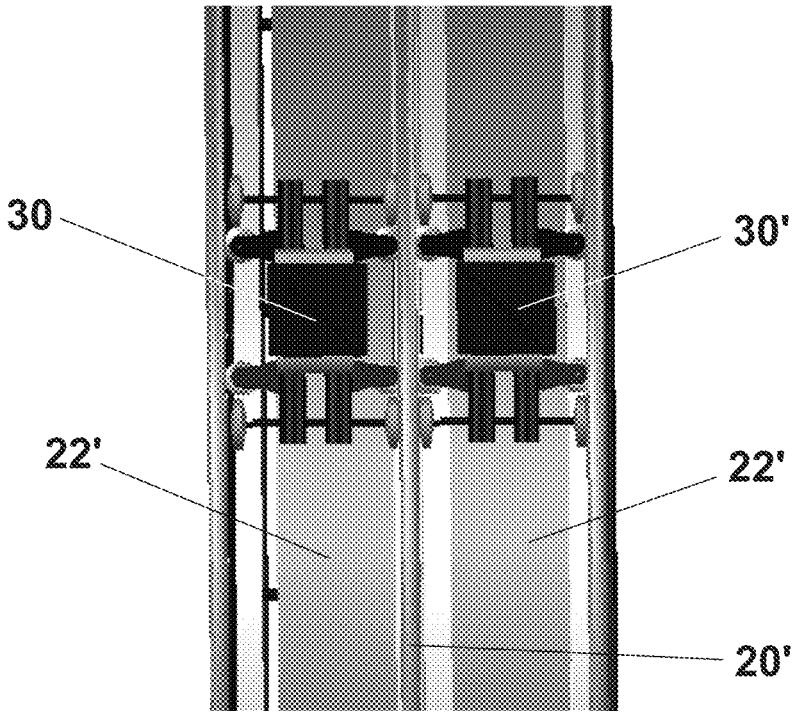
FIG. 36 is a detailed view of a constructive variant of the carts on the tracks.
Figure 37:
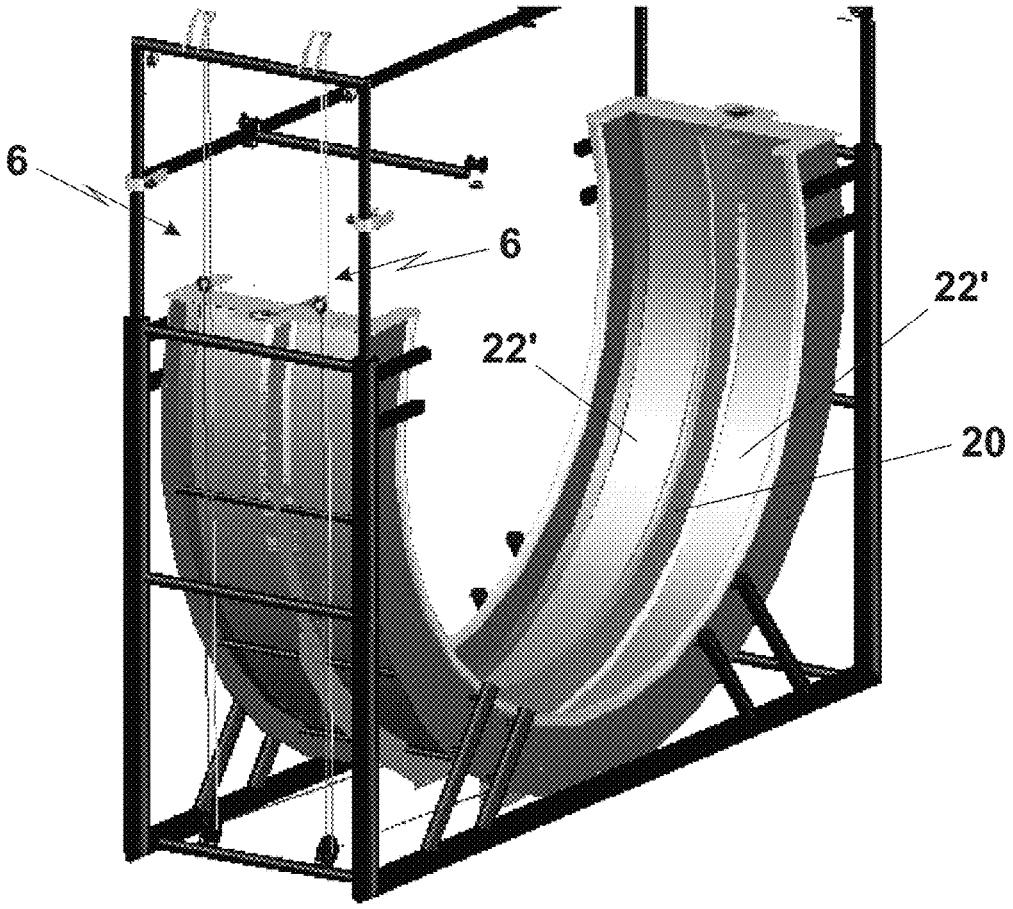
FIG. 37 is a perspective view of a constructive variant of the equipment tracks, highlighting the load systems of the carts.

Still with relation to the adjustment system (7), in accordance with FIG. 24, optionally, it may be operated by an engine (M) which drives a round connecting rod (700) provided with a pinion (701) at the end thereof connected to the crown (702) of a vertical spindle (703) that receives at the upper end thereof a bar (704) provided with a hole that is aligned to a nut (705) and the ends of which are affixed to the connecting rods (51), thus allowing same to move vertically by actuating the engine (M) through a button provided in the equipment.

The cart (3) is divided into two portions, a sliding portion (31) and a rotating portion (32). The sliding portion (31) is provided with a rectangular structure (311) provided in the center thereof with a lower support (312) having a hole (313) and a ring-shaped rib (314) for receiving the inner portion (33') of the bearing (33), as well as axles (315) that make it possible to attach casters (316) that slide on the track (2) for moving the cart (3) from one side to the other, and supports (317) for the side casters (318) that slide on the sides of the track (2) to prevent the transverse displacement of the cart (3). The rotating portion (32) is provided with a rectangular structure (321) provided in the center thereof with an upper support (322) having a pin (323) and a ring-shaped rib (324) to be inserted onto the inner part (33') of the bearing (33) and affixed by the respective bolt (323) through a nut in the lower portion when they are assembled. A board (324) made of wood or polymer covered with a cushion is provided on the structure (321).

Depending on the exercise to be performed, the movement of said cart (3) can be restrained by the movement restrainer (34) affixed to the cross bars (21), and the cart may rotate 360 degrees through the bearing (33) or have the two portions (32 and 31) affixed thereto by a lock (35) that joins the two portions through a threaded pin.

Also, number of safety accessories may be provided in the equipment, such as belts and handles (100) that are affixed by a spring hook to the upper structure (5).

Optionally, the tracks (2; 2'), could be split longitudinally, with the introduction of an intermediate track composed of an upper track (20') and a lower track (20) which are similar to tracks (2; 2'), but provided with two plates (24') of a lower width, on which floors (22') made of wood, fiber or polycarbonate are to be affixed to the cross bars (21) through screws, to be used with two carts (30 and 30') similar to cart (3), but having half the width thereof, each one of which shall be connected to a load system (6), thus allowing for the interspersed movement of the legs.

Optionally, the height of the carts (30 and 30') may exceed the height of the intermediate track, thus making it possible to connect same through a pin, wherein both of them move in the same direction.

The concave shape of the thus obtained equipment allows for the front or back ascent and the front or back descent, through the cart, associated to the rotation of same, as well as several points for supporting the upper and lower limbs, and allows for the integration and alteration of combinations of movements and directions of movements, at the same time and during the same exercise, thus providing agility, concentration, coordination, force, resistance and balance, while the user holds one of the bars and urges the cart with the legs, in accordance with the exercise.

As an example of the integrated movements carried out by the present equipment, it is seen that it is possible to combine and alternate the work direction and speed of all the joints of the body at one time, that is, by moving the cart up or down in the equipment, the hip can be rotated, inclined, deflected and extended to any side, and an infinite number of ways and sequences may be used during the movement. All this may be accomplished without changing the support of the bars.

Through the use of the intermediate track and two carts, the equipment makes it possible to perform the exercises with alternating movements.

Optionally, the above mentioned movements may be carried out by dynamically changing the support in the bars without interrupting the exercise.

Also, it is possible to perform exercises with a portion of the body out of the equipment, that is, on the floor or by using a support on a specific bench.

The fitness equipment provides the following advantages:

The equipment, by means of the cart, makes it possible to change the height when it slides along the track, combining side rotations during the exercises;

In view of the high degree of freedom of direction of the movements, it makes it possible to integrate the column and limbs in all amplitudes thereof, thus making it possible to perform complex movements for the joints in a safe way, encouraging the user to perform movements that are carried out only in sports requiring a high degree of complexity, for example, the integrated movements of rotation, inclination, deflection, extension and circumduction of the column, hip and members at the same time; and It makes it possible to change the position in the bars without interrupting the movement, thus providing the user with more agility and motor coordination.

The scope of the present invention shall not have to be limited to the constructivity of the equipment, but to the terms defined in the claims and the equivalents thereof.

The invention claimed is:

1. An apparatus for physical exercise, comprising:

a frame;

a track supported by the frame for rollably supporting a cart and restricting the cart from leaving the track, the track being substantially semi-circular in shape; the cart mounted for rolling movement along the track and constructed and arranged for supporting a user;

a pair of end covers affixed to ends of the track to prevent the cart from moving beyond the ends of the track;

an upper structure extending from the frame upwards and above said track, the upper structure having a pair of parallel horizontal bars extending across and above the track, and being releaseably attached to the upper structure such that the pair of parallel horizontal bars can be selectively raised away from or lowered toward the track, and adjustable restraining means attached to the upper structure and operatively connected to the cart to provide an adjustable amount of restraining against movement of the cart along the track.

2. The apparatus according to claim 1, wherein the track further comprises first and second "U"-shaped members having "T"-shaped cross-sections arranged adjacent and substantially parallel to one another, a plurality of cross bars extending between and connecting the first and second "U"-shaped members, and a floor extending between the first and second "U"-shaped members and supported by the plurality of cross bars.

3. The apparatus according to claim 2, further comprising a third "U"-shaped member having a "T"-shaped cross section positioned between and substantially equidistant from the first and second "U"-shaped members, and a second cart for supporting the user, mounted for rolling movement along the track, wherein the first cart is mounted for rolling movement along the first and third "U"-shaped members, and the second cart is mounted for rolling movement along the second and third "U"-shaped members.

4. The apparatus according to claim 3, wherein the height of the first and second carts exceed the height of the third "U"-shaped member, and the first and second carts are adapted to be connected to one another.

5. The apparatus according to claim 2, wherein the floor is made of wood, fiber or polycarbonate.

6. The apparatus according to claim 1, wherein the frame further comprises:

two "U"-shaped tubular structures arranged adjacent and substantially parallel to one another;

a plurality of crosspieces extending between and connecting the "U"-shaped tubular structures; and a plurality of horizontal bars and a plurality of oblique bars extending from the "U"-shaped tubular structures for attachment to and support of the track.

7. The apparatus according to claim 1, wherein the pair of end covers are "C"-shaped, and wherein a first end cover of the pair of end covers is provided with a protuberance forming a hole for receiving cables operatively connected to the pair of parallel horizontal bars to selectively raise or lower said bars, and a second end cover of the pair of end covers is provided with a semicircular channel for receiving cables or elastic bands associated with the adjustable restraining means.

8. The apparatus according to claim 1, wherein the upper structure further comprises two inverted "U"-shaped bodies arranged adjacent to and substantially parallel to one another, the pair of parallel horizontal bars of the upper structure extending between the "U"-shaped bodies to connect "U"-shaped bodies, the upper structure further comprising a plurality of crosspieces extending between the pair of parallel horizontal bars, said crosspieces being releaseably attached to the pair of parallel horizontal bars such that the crosspieces can be selectively moved along the length of the pair of parallel horizontal bars.

9. The apparatus according to claim 1, wherein the adjustable restraining means further comprises a non-elastic cable extending from the cart at a first end thereof to an attachment point at a second end thereof, and a plurality of elastic bands of differing intensities of elastic modulus, each of said plurality of elastic bands being selectively attachable to the attachment point at a first end, and to the upper structure at a second end.

10. The apparatus according to claim 1, further comprising a ratchet operatively connected to the pair of parallel horizontal bars of the upper structure via a plurality of cables to selectively raise or lower said pair of parallel horizontal bars.

11. The apparatus according to claim 1, wherein the pair of parallel horizontal bars bars are releasably attached to the upper structure via a plurality of butterfly locks comprising toothed plates attached to the upper structure, the toothed plates forming grooves into which swivel rods extending between ends of the pair of parallel horizontal bars can be placed.

12. The apparatus according to claim 1, further comprising an engine operatively connected to the pair of parallel horizontal bars of the upper structure to selectively raise or lower the pair of parallel horizontal bars.

13. The apparatus according to claim 1, wherein the cart further comprises a sliding portion and a board for supporting the user mounted to the sliding portion for rotation about an axis perpendicular to a face of said board, the sliding portion comprising a frame and a plurality of wheels mounted to said frame to facilitate rolling movement of the frame of the cart along the track.

14. The apparatus according to claim 1, further comprising a plurality of belts and handles affixed to a plurality of spring hooks extending from the upper structure.

* * * * *